US006332955B1

(12) United States Patent
Meschenmoser

(10) Patent No.: US 6,332,955 B1
(45) Date of Patent: Dec. 25, 2001

(54) PRESS ARRANGEMENT AND METHOD FOR TREATING A FIBROUS WEB

(75) Inventor: Andreas Meschenmoser, Horgenzell (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/291,196

(22) Filed: Apr. 14, 1999

(30) Foreign Application Priority Data

Apr. 15, 1998 (DE) ..... 198 16 673
Jun. 19, 1998 (DE) ..... 198 27 483
Jun. 19, 1998 (DE) ..... 298 11 048 U

(51) Int. Cl.[7] ..... D21F 3/04
(52) U.S. Cl. ..... 162/360.3; 162/358.3
(58) Field of Search ..... 162/358.3, 360.3, 162/205

(56) References Cited

U.S. PATENT DOCUMENTS

| | | | | |
|---|---|---|---|---|
| 4,518,460 | | 5/1985 | Hauser et al. | 162/361 |
| 4,648,942 | * | 3/1987 | Wanke et al. | 162/286 |
| 4,915,790 | * | 4/1990 | Dahl | 162/358.3 |
| 4,923,570 | | 5/1990 | Steiner et al. | 162/358.3 |
| 5,256,259 | * | 10/1993 | Schiel | 162/360.3 |
| 5,393,383 | | 2/1995 | Karvinen et al. | 162/274 |
| 5,404,811 | | 4/1995 | Schiel et al. | 162/273 |
| 5,865,954 | | 2/1999 | Laapotti | 162/205 |

FOREIGN PATENT DOCUMENTS

| | | | | |
|---|---|---|---|---|
| 1172888 | | 8/1984 | (CA) | |
| 3607941 | | 5/1987 | (DE) | |
| 3718462 | | 12/1987 | (DE) | |
| 3808293 | | 9/1989 | (DE) | |
| 8805966 | | 10/1989 | (DE) | |
| 3815278 | | 11/1989 | (DE) | |
| 9206340 | * | 9/1992 | (DE) | 162/360.3 |
| 19642046 | | 4/1998 | (DE) | |
| 29723115 | | 5/1998 | (DE) | |
| 19652018 | | 6/1998 | (DE) | |
| 19654282 | | 6/1998 | (DE) | |
| 19708966 | | 9/1998 | (DE) | |
| 19713645 | | 10/1998 | (DE) | |
| 29811048 | | 10/1998 | (DE) | |
| 0950758 | | 10/1999 | (EP) | |
| 697774 | | 9/1953 | (GB) | |
| 2182367 | | 5/1987 | (GB) | |
| 82/02567 | | 8/1982 | (WO) | |
| 93/12289 | | 6/1993 | (WO) | |

* cited by examiner

*Primary Examiner*—Karen M. Hastings
(74) *Attorney, Agent, or Firm*—Greenblum & Bernstein, P.L.C.

(57) ABSTRACT

A press arrangement and method for the treatment of a fibrous material web (10) which includes a lower shoe press roll (20), with which two upper press rolls (22, 24) are associated, with which the shoe press roll (20) forms in each case a press nip (S1 or S2) elongated in the direction of travel of the web (L). The first elongated press nip (S1) viewed in the direction of travel of the web (L) is double felted.

1 Claim, 3 Drawing Sheets

PRESS ARRANGEMENT AND METHOD FOR TREATING A FIBROUS WEB

CROSS-REFERENCE TO RELATED APPLICATIONS

The present application claims priority under 35 U.S.C. §119 of German Patent Application No. 198 16 673.7 filed Apr. 15, 1998, of German Patent Application No. 198 27 483.1 filed Jun. 19, 1998, and of German Patent Application No. 298 11 048.2 filed Jun. 19, 1998, the disclosures of which are expressly incorporated by reference herein in their entireties.

BACKGROUND OF THE INVENTION

Field of the Invention

The invention concerns a press arrangement for the treatment of a fibrous material web, in particular a paper or cardboard web and a method for treating a fibra as material web.

SUMMARY OF THE INVENTION

The invention resides in creating a press arrangement of the type mentioned in the Background of the Invention, whose structure is as simple and compact as possible and whose vacuum requirement as well as whose drive power is as low as possible. In addition, in particular, a closed web path is also possible.

According to the invention, two upper press rolls are associated with one lower shoe press roll, and, in each case, the shoe press roll forms with the two upper press rolls a press nip elongated in the direction of travel of the web. Additionally, the first elongated press nip viewed in the direction of travel of the web is double felted.

Because of this design, the formerly customary large press suction roll provided with a thick jacket is eliminated, whereby the vacuum requirement is clearly reduced. Overall, a clearly reduced drive power results. In particular, a closed web path is also readily possible, such that the corresponding press section is also conformed, in particular for liners with a white top. Additionally, because of the use of a double-acting shoe press roll, the number of necessary press rolls is reduced to a minimum, i.e., only three press rolls are needed as a maximum. Accordingly, the number of necessary press filters is also reduced. Lower overall operating costs also result from the reduced use of felt. These operating costs are also reduced by the lower vacuum requirement for tubular suction devices as well as the lower drive power. Also favorably affecting operating costs is the fact that fewer guide rolls, regulators, voltages, tubular suction devices, doctor blades, channels, etc. are necessary and, in particular a simpler, leverless, and compact support is possible. Thus, as a rule, as few as three cantilever carriers suffice. Only a Keller felt is required, such that more space is available for specific aggregates such as the pulper. The maintenance outlay is also clearly lower overall. With the elimination of press roll doctors, the investment costs are further minimized. The absence of blade wear has a favorable effect on the operating costs as well as availability. Roll wear from doctor action no longer occurs. The lubricant spray pipe can be eliminated. Paper draw downstream from the press section is negligible. Since the number of rolls and types of rolls is reduced to a minimum, the number of reserve rolls to be stocked is also accordingly low, which in turn has a favorable effect on operating costs. Thus, as a rule, only three reserve rolls must be stocked, i.e., a press roll, for example, an internally supported sag compensation roll or a solid roll, a transfer-suction roll, and a felt guide roll. It should be taken into account that, as a rule, pickup, transfer, and transport suction rolls have the same structure. For that reason, operating and maintenance costs can be kept low. The long roll service lives also are advantageous. Thus, the use of a press suction roll is eliminated. Virtually only hard coatings are still used. Moreover, convexing is no longer necessary. Consequently, linear force regions without restrictions are possible. There is no linear force dependency between the two press nips. Because of the compact design, the space requirement for the relevant press section is minimal. Thus, for example, with a width of 5.5 meters, approximately 10 meters or less suffice in the longitudinal direction of the press arrangement. As a result of the low space volume, there are low operating costs both for the machine and for the associated structure. No web stabilizers are necessary between the press nips. A single press jacket suffices for the double-acting shoe press roll. Press jacket replacement is easier to schedule. Since the shoe press roll is on the bottom, this press jacket replacement is, in particular, also significantly simpler to execute. There is good accessibility from both sides. During press jacket replacement, no oil can reach the associated felt. Moreover, the felt does not interfere with the jacket replacement. The double-acting shoe press roll can readily be retracted for service work. For this, for example, a retraction cart on a cantilever carrier is possible. No felt removal is necessary for such a retraction. Felt and roll replacement is designed extremely simple overall. One cantilever device per felt suffices. There is good accessibility to the rolls for roll replacement by means of a crane. A variation in format width is possible with no problem. In principle, closed leading of the web from the wire section through the end of the drying section is possible.

In a practical embodiment of the press arrangement according to the invention, the second elongated press nip viewed in the direction of travel of the web is single felted, such that a low remoisturizing drainage is guaranteed with this press nip. The fibrous material web is preferably guided between the relevant felt and the back upper press roll through the second elongated press nip. The second elongated press damp is thus felted on the bottom. The upper back roll can in this case have an at least substantially closed surface, i.e., be smooth. Thus, in particular a discharge favorable roll coating is possible, such as, in particular, a so-called peeler.

In an alternative embodiment of the press arrangement according to the invention, the second elongated press nip viewed in the direction of travel is double felted. This yields overall space-saving and symmetrical drainage. In paper production, in particular, the two-sidedness of the paper is also improved, a fact which is advantageous in particular with regard to smoothness and printability.

In the preferred practical embodiment of the press arrangement according to the invention, a total of three felts at most is provided. One felt can be guided through both elongated press nips. If the second elongated press nip is only single felted, two felts suffice as a result. If the second elongated press nip is double felted, three felts suffice, in principle.

With a closed web path from the wire to the drying section, high runability is achieved. Breaks inside the press arrangement are virtually excluded. In addition, manual leading of the fibrous material web is eliminated, a fact which brings with it higher operational safety and high machine availability. Because of the absence of open stretches, it is possible to achieve virtually no paper stretching and no tears in the web. Also, no fluctuations in tension acting on the paper occur between the presses. Synchronism is achieved by the coupling of the tractive force via the press jacket and felt.

Between the two elongated press nips formed with the shoe press roll, the fibrous material web can preferably be guided together with a felt around a deflecting roll preferably designed as a suction roll.

In a particular practical embodiment, a felt guided through at least the first elongated press nip is simultaneously provided as a pickup felt. The pickup felt can be guided preferably together with the fibrous material web, in particular along a rising intake path into the first elongated press nip, whereby, among other things, ideal web guidance for brown and white papers results. In principle, closed and open operation are possible. Downstream from the second elongated press nip, the fibrous material web can be guided by a deflecting roll, designed preferably as a suction roll, to a subsequent drying section.

Downstream from the second elongated press nip, the fibrous material web can, for example, be guided on a bottom felt and then preferably picked up from this bottom felt by a deflecting roll designed as a suction roll. Here, the bottom felt is preferably guided out of the second elongated press nip along a descending discharge path, whereby, in particular, good web discharge into the press pulper as well as overall optimum web transfer into the drying section are obtained.

In an alternative embodiment of the press arrangement according to the invention, the fibrous material web is pulled out of the second elongated press nip, preferably by a deflecting roll designed as a suction roll, in the free stretch, to keep remoisturizing low.

The flexible press jacket of the shoe press roll and/or the front upper press roll forming the first elongated press nip with the shoe press roll is blind drilled and/or grooved. If the second elongated press nip is also double felted, the back upper press roll is also preferably correspondingly blind drilled and/or grooved. Thus, the drainage of at least one elongated press nip may take place at least partially by centrifugation of water into at least one channel, possibly with at least one integrated water doctor or the like. Thus, not only optimum drainage of the respective press nip is ensured. Lighter press felts may also be used. And finally, there is improved felt conditioning by tubular suction devices and spray pipes.

In a preferred practical embodiment, at least one upper press roll is formed by an internally supported hollow roll, preferably a sag compensation roll. In principle, at least one upper press roll can also be formed by a solid roll.

For the leading of the web, a blowpipe extending preferably at least substantially over the entire web width can be provided, in particular in the region of the back upper press roll.

A suction device may be disposed in the region of the roll wedge formed downstream from the second elongated press nip to collect centrifuged water and/or to suck the fibrous material web onto a bottom felt guided out of the press nip. With web guidance on the bottom felt, the separation point is consequently subjected to suction. Instead of the suction device, a transfer suction roll, for example, may also be provided at the separation point. As already mentioned, the fibrous material web can, however, also be drawn out of the second elongated press nip in the free stretch, which brings with it lower remoisturizing.

In a preferred practical embodiment of the press arrangement according to the invention, the shoe press roll is provided with position-stable press jacket guidance.

According to another variant embodiment, the shoe press roll includes for this an external hollow carrier secured at its ends against torsion, a flexible press jacket surrounding the hollow carrier and guided thereby, two support devices, by which the press jacket is supported internally in the region of the two elongated press nips, and an internal carrier, on which the press jacket is supported by means of the two support devices through the hollow carrier jacket directly on the internal carrier. One respective support device preferably includes at least one press shoe guided on the hollow carrier and at least one support element, by which the press shoe is supported directly on the internal carrier.

Thus, independently of the respective operating conditions, a highly position-stable press jacket guidance and, thus, also the most optimum web and/or felt guidance possible is always guaranteed. The outer hollow carrier is used only for press jacket guidance. There is no direct transfer of press nip support forces by the hollow carrier. However, it absorbs the lateral shoe support force, which corresponds to the frictional force in the relevant press nip. Consequently, the outer hollow carrier is not stressed to bending. Instead, it remains straight even during operation. The support forces are absorbed by the internal carrier, which can freely sag in all directions without shoe, press jacket, felt, and/or web guidance being negatively affected thereby. The respective support devices and thus the relevant press nips may be adjusted separately. In addition, the press shoes may be of the same width. And finally, the support elements can have pistons inside the roll. The thermal loading of such internal pistons is relatively low compared to direct shoe pressure.

The support elements may in each case be coupled with the relevant press shoe by a joint.

The supporting force applied by the respective support device is variably adjustable. The hollow carrier and the internal carrier are mounted preferably equidistantly on their ends. The supporting forces applied by the two support devices can be separately adjustable.

In accordance with another advantageous variant of the press arrangement according to the invention, the shoe press roll includes a non-rotatably mounted carrier for position-stable press jacket guidance, a flexible press jacket surrounding the carrier, as well as two support devices disposed between the carrier and the press jacket, by which the press jacket is supported on the carrier in the region of the two elongated press nips, whereby in this case a device is provided to control the sagging of the carrier.

As a result, the carrier can be controlled by the relevant device, in particular such that a resultant sagging generated by the variously oriented pressing forces is at least substantially compensated. Automatic compensation is possible by use of the relevant device. Independently of the pressure level set in each case, there is always a straight and position-stable starting position. This means that, in particular, even during runup and rundown of the linear force, there are no noteworthy geometric changes in the press roll. In addition, the lateral shields of a respective press jacket clamp also no longer experience slanting, because of the absence of beam bending. As a result, in particular, trouble-free travel of the press jacket, of a respective press filter, and of the fibrous material web are thus always guaranteed.

The control of the sagging of the carrier can be implemented in different ways. Thus, for example, a bimetal carrier may be provided. In this case, the control of the sagging include a heating device to heat the carrier. It is, for example, also conceivable to use a slotted carrier, which is braced by an appropriate element as desired.

Another embodiment includes at least one inner and/or at least one outer auxiliary carrier is associated with the carrier and that the control of the sagging includes a mutual radial bracing element of this carrier.

In a preferred practical embodiment, the carrier is provided as an outer hollow carrier, which is associated with a non-rotatably mounted inner carrier, whereby the control of the sagging includes a mutual radial bracing device of the hollow carrier and of the associated inner carrier.

The respective bracing may occur, for example, hydraulically, pneumatically, mechanically, thermally, and/or electromagnetically.

If the control of the sagging of the carrier includes at least one support device disposed between a hollow carrier and an inner carrier, this support device preferably includes at least one group of support elements extending crosswise to the direction of travel of the web. In the case of the use of a hollow carrier and an inner carrier, these are expediently mounted equidistantly on their ends.

The two support devices disposed between the carrier and the press jacket include in each case at least one press shoe as well as a plurality of support elements disposed in a group extending crosswise to the direction of travel of the web, which can be formed, for example, by respective cylinder/piston units. In principle, the support elements of a support device, disposed, for example, between the hollow carrier and the inner carrier, can also include such cylinder/piston units.

A preferred practical embodiment of the press arrangement according to the invention is distinguished in that the shoe press roll includes two outer support devices disposed between the hollow carrier and the press jacket having a space between them in the circumferential direction, by which the press jacket is supported against the hollow carrier in the region of two elongated press nips, as well as at least one inner support device disposed between the hollow carrier and the inner carrier, by which the sagging of the hollow carrier can be controlled such that a sagging of the hollow carrier produced by the variously oriented pressing forces is at least substantially compensated. The direction of action of the inner support device can lie, in particular, in the resultant direction of action of the two outer support devices.

For example, in the case that the supporting forces applied by the two outer support devices are of substantially the same size and the radial directions of action of the two outer support devices are offset by approximately 120°, all three forces applied by the two outer support devices and the inner support device can be at least substantially the same size, such that an equilateral triangle of forces results. In particular, in such a case, the groups of support elements of the two outer support devices and the inner support device can have the same pitch and their support elements can have the same piston areas. The two outer support devices and the inner support device can then, for example, be acted upon by the same preferably variably adjustable pressure. The forces generated by the two outer support devices and the inner support device are, consequently, in equilibrium, whereby the direction of action of the inner support device lies in the bisector of the angle between the two radial directions of action of the two outer support devices.

If the forces applied by the two outer support devices are at least substantially of the same size, they can form an isosceles triangle of forces with the force applied by the inner support device. In this case as well, the groups of support elements of the two outer support devices can again have the same pitch and their support elements can have the same piston areas. To generate a force at least substantially compensating the resulting force of the two outer support devices, the entire piston area of the inner support device can be adapted accordingly. This can, for example, take place through the number of support elements, whereby the individual piston areas of these support elements associated with the inner support device are preferably of the same size as the individual piston areas of the support elements of the two outer support devices. The groups of pistons of the two outer support devices as well as the inner support device can again be acted upon by the same preferably variably adjustable pressure. The direction of action of the inner support device lies in this case also again in the bisector of the angle between the two radial directions of action of the two outer support devices. Up to a possibly still existing small percentage deviation due to the selected total pitches in the group of support elements associated with the inner support device, all forces are again in equilibrium.

With such an embodiment of the shoe press roll, bringing with it an isosceles triangle of forces, in which the total piston area of the inner support device is appropriately adapted to generate a force at least substantially compensating the resultant force of the two outer support devices, this total area can also be appropriately adapted by the size of the individual piston areas. Here, the group of support elements of the inner support device again has the same pitch as the group of support elements of the two outer support devices. All groups of support elements can also again be acted upon by the same preferably variably adjustable pressure. In addition, the direction of action of the inner support device again lies in the bisector of the angle between the two radial directions of action of the two outer support devices. All forces are again in equilibrium, up to a possibly still existing small percentage deviation due to the selected standard piston diameter in the group of support elements associated with the inner support device, which possibly does not exactly agree with the calculated diameter.

In principle, an embodiment of the shoe press roll is, however, also possible in which the forces applied by the two outer support devices are of different sizes and form a scalene triangle of forces with the force applied by the inner support device. In this case, the group of support elements of the two outer support devices can have a different pitch and/or their support elements can have piston areas of different sizes.

In this case as well, the total piston area of the inner support device can be appropriately adapted to generate a force at least substantially compensating the resultant force of the two outer support devices. Since the forces applied by the two outer support devices are of different sizes, in the present case, the direction of action of the inner support device does not lie in the bisector of the angle between the two radial directions of action of the two outer support devices. The two outer support devices as well as the inner support device can again be acted upon by the same preferably variably adjustable pressure. As a result, here again all forces are in equilibrium. Moreover, in this case, the pressure shoes may have the same width viewed in the direction of travel of the web. This yields the advantage that only one reserve shoe is necessary.

In principle, an embodiment is also conceivable in which the forces applied by the two outer support devices and the inner support device are kept in equilibrium by the individual pressures acting upon the support elements. In this case, the directions of action of the various support devices as well as the piston areas and pitches or distances between the support elements are freely selectable. However, with such an embodiment, the control outlay is somewhat greater.

In particular with the exemplary embodiments bringing with them in each case an equilateral or isosceles triangle of forces, the pressure profile developing in the different press nips can, for example, be adapted as desired by an appropriate choice of the respective shoe widths measured in the direction of travel of the web.

The pressure shoes may be equipped with a double-piston pressure arrangement to vary the pressure curve in the press nips.

An advantageous embodiment is distinguished in that the press jacket is offset relative to the hollow carrier viewed in the cross-sectional plane of the roll, whereby, in particular greater shoe widths are possible.

It is also advantageous if the press jacket of the shoe press roll has the shape of a polygon, at least in sections. Such a polygonal jacket design supports the centrifuging of water from the press jacket. A water doctor is thus no longer required, which is an advantage, in particular with limited structural space. It has been demonstrated in practice that such a polygonal jacket design has no disadvantageous effect on the service life of the jacket.

Overall, this yields an advantageous pressing concept with a closed web path, two shoe presses without a press suction roll, and press nip drainage, in particular by centrifuging of water.

The invention also envisions a method for treating a fibrous material web in an apparatus as described in more detail above.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
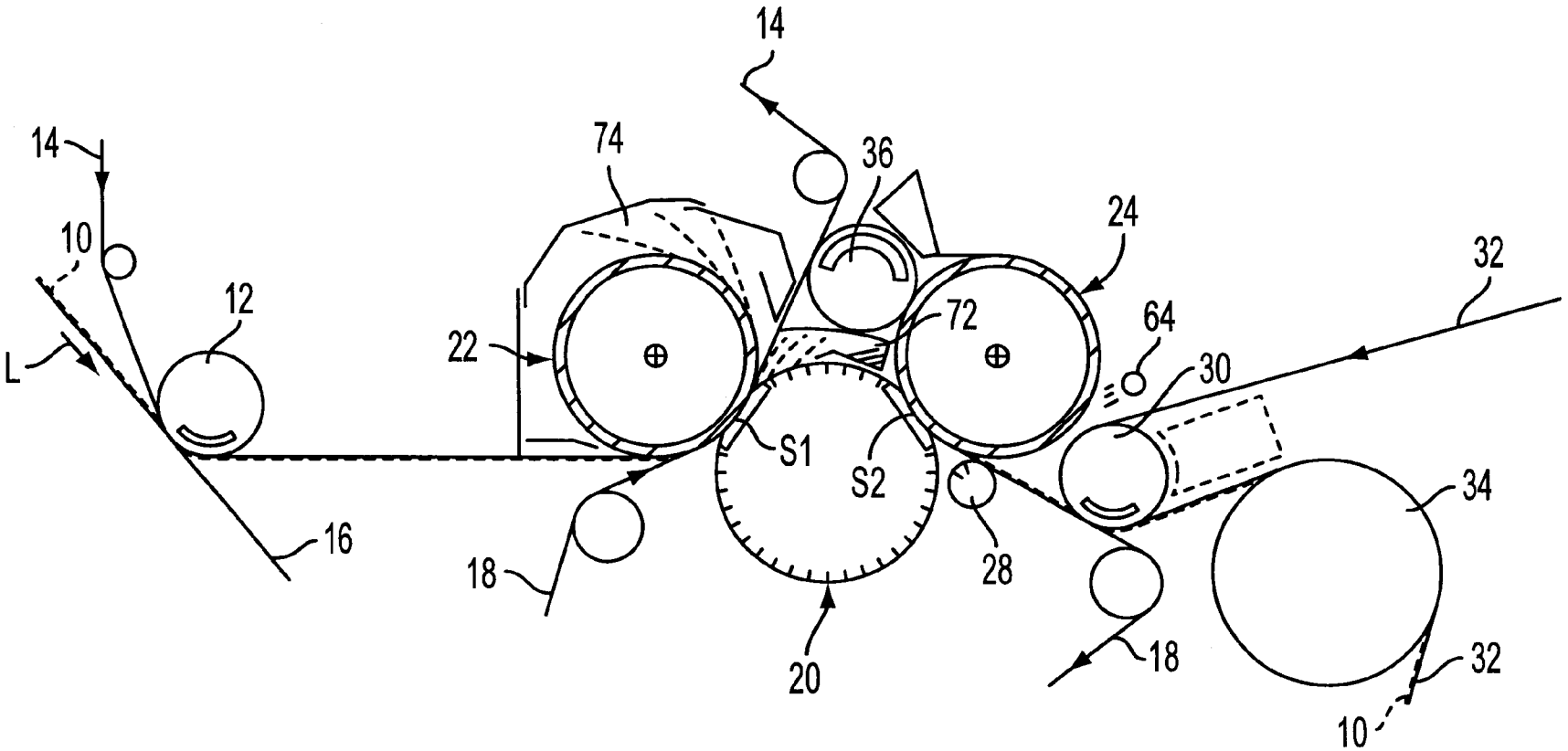
FIG. 1 is a schematic, partially sectional depiction of a first embodiment of a press arrangement with two elongated press nips, wherein the first elongated press nip is double felted and the second elongated press nip is single felted.

FIG. 1 shows, in a purely schematic, partially sectional depiction, a first embodiment of a press arrangement for the treatment of a fibrous material web 10, which can be, in particular, a paper or cardboard web.

The fibrous material web 10 is picked up in the region of a suction roll 12 by a top felt 14 of a wire 16, and then fed together with a bottom felt 18 into a first press nip S1 elongated in the direction of travel of the web L. Following that, the fibrous material web 10 is fed together with the bottom felt 18 into a second press nip S2 elongated in the direction of travel of the web L.

Figure 3:
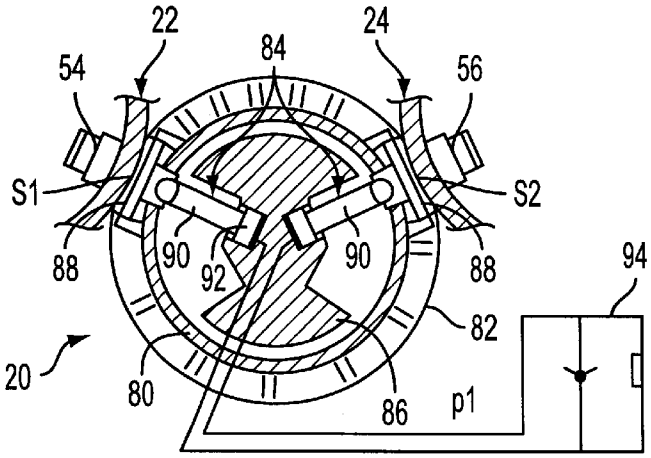
FIG. 3 is an enlarged, detailed cross-sectional depiction of a first embodiment of a position-stable shoe press roll useable in the press arrangement according to FIG. 1 or 2.

As can be seen in FIG. 1, the two press nips S1 and S2 elongated in the direction of travel of the web L are formed between a lower shoe press roll 20 and two upper press rolls 22, 24 associated therewith, internally supported in the region of the press nips S1, S2, respectively, which are, in the present case, sag compensation rolls (cf., in particular FIG. 3 as well). While the press roll 22 is disposed obliquely to the left above the shoe press roll 20, the additional press roll 24 is provided obliquely to the right above the shoe press roll 20. Downstream from the second press nip S2 elongated in the direction of travel of the web L, the fibrous material web 10 is picked up by a drying wire 32 in the region of a deflecting roll 30 designed as a suction roll and fed to the first drying cylinder 34 of a drying section.

As is discernible from FIG. 1, downstream from the first elongated press nip S1, the fibrous material web 10 is guided together with the bottom felt 18 around a suction roll 36 before it is picked up by the press roll 24 and is fed to the second elongated press nip S2. This yields a completely closed web path, all the way, in fact, from the pickup of the fibrous material web 10 by the top felt 14 of the wire 16 simultaneously serving as a pickup felt until transfer to the drying section. Further, it is noted that press roll 24 may be a heated roll.

Figure 4:
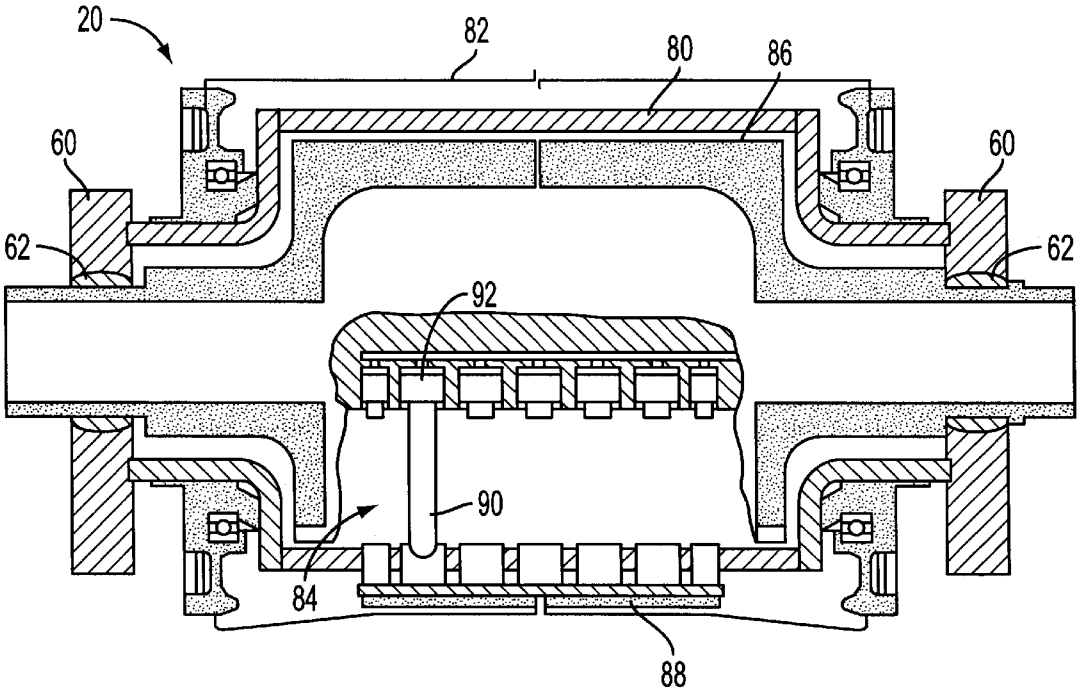
FIG. 4 is a schematic longitudinal section through the position-stable shoe press roll depicted in FIG. 3.

As also shown in particular in FIGS. 3 and 4, the lower shoe press roll 20 includes an outer hollow carrier 80 secured on its ends against torsion, a flexible press jacket 82 surrounding the hollow carrier 80, as well as two support devices 84, by means of which the press jacket 82 is supported internally in the region of the two press nips S1 and S2.

A likewise non-rotatably mounted inner carrier 86 is associated with the outer hollow carrier 80 guiding the press jacket 82. The press jacket 82 is supported against the inner carrier 86 directly through the jacket of the hollow carrier 80 by the two support devices 84.

The two support devices 84 include in each case at least one press shoe 88 guided on the outer hollow carrier 80 and a plurality of support elements 90 disposed in a group crosswise to the direction of travel of the web L, by which the press shoe 88 is supported directly against the inner carrier 86. The support elements 90 have pistons 92 radially inward, on, or in the inner carrier 86. On the radially outward end, these support elements 90 are coupled with the press shoe 88 by means of a respective joint. The support forces applied by the two support devices 84 are preferably variable and, for example, may also be separately adjustable, in particular by means of a Delta-P-valve 94 (cf. in particular FIG. 3).

As may be best discerned with reference to FIG. 4, the hollow carrier 80 and the inner carrier 86 are mounted equidistantly from each other on their ends in lateral supports or mounts 60. The bearings of the lower shoe press roll 20 and the two upper rolls 22, 24 are each in a common plane on the two sides.

Bushings 62, which have a spherical outer bearing surface and are accommodated in an appropriately designed recess of the respective mount 60, are pushed onto the two ends of the inner carrier 86. By means of the ball and socket joint thus formed, the ends of the inner carrier 44 are tippable relative to the hollow carrier 80 stationarily mounted on the mounts 60, such that the inner carrier 86 can be freely flexed.

Figure 2:
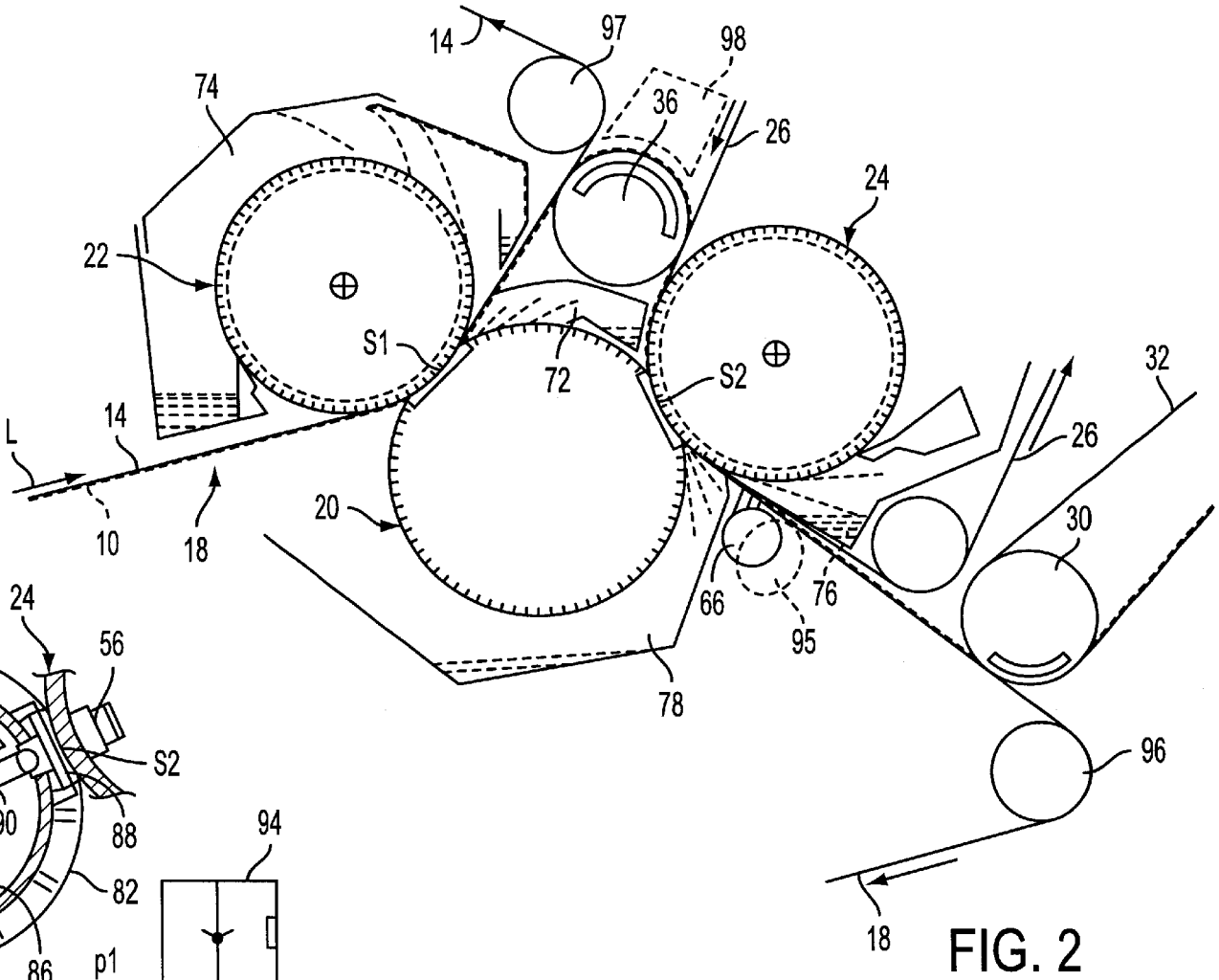
FIG. 2 is a schematic, partially sectional depiction of another embodiment of a press arrangement, wherein both the first and the second elongated press nips are in each case double felted.

The embodiment of a press arrangement depicted in FIG. 2 differs from that in FIG. 1 first in that in it the second elongated press nip S2 is also double felted. For this, an additional top felt 26 is provided, which is guided as depicted around the right upper press roll 24 and downstream from the second elongated press nip S2 is again separated from the fibrous material web 10. The fibrous material web 10 is thus guided between the bottom felt 18 and the top felt 14 through the second elongated press nip S2.

In addition, the fibrous material web 10 is fed between the top felt 14 and the bottom felt 18 along a rising intake path into the first elongated press nip S1.

In all exemplary embodiments, both the lower shoe press roll 20 and the front upper press roll viewed in the direction of travel of the web L are blind drilled and/or grooved.

In the embodiment depicted in FIG. 1 with a single felted second press nip S2, the back upper press roll 24 is provided with at least one substantially closed surface, whereby it can have, for example, a so-called peeler coating. The drainage of the elongated press nip S1 occurs through centrifugation of water into channels 72, 74, which is possible because of the blind drilled or grooved rolls 20, 22. As is discernible in FIG. 1, downstream from the first elongated press nip S1, such drainage occurs on both sides by centrifugation of water, for which the two channels 72, 74 are disposed on different sides of the fibrous material web 10. Additional water doctors can be provided in these channels.

In the region of the roll wedge formed downstream from the second elongated press nip S2, a suction device 28 is provided to collect centrifuged water and/or to suck the fibrous material web 10 onto the bottom felt 18 guided out of the press nip S2. The channel 74 can, in principle, also be provided as a combined channel and web holding box.

In the region of the back upper press roll 24, a blowpipe 64, preferably extending at least substantially over the entire width of the web, which serves to lead the web, is provided.

In the embodiment depicted in FIG. 2, in which the second elongated press nip S2 is also double felted, the back upper press roll 24 is also blind drilled and/or grooved. In this case, the second elongated press nip S2 is also drained by centrifugation of water into channels 76, 78. As can be discerned from FIG. 2, downstream from the second elongated press nip S2 such drainage occurs on both sides by centrifugation of water, for which the two channels 76, 78 are provided on different sides of the fibrous material web 10 guided out of the press nip S2.

The drainage to be effected by the felts can thus be accordingly less. To support the centrifugation of water from the press jacket 82 of the shoe press roll 20, the press jacket 82 may be designed in the shape of a polygon, at least in sections.

As can be discerned from FIG. 2, downstream from the second elongated press nip S2, a suction device 66 is provided, by means of which the fibrous material web is sucked away from the top felt 26 onto the bottom felt 18 in the region of the separation point. Instead of this suction device, a separating suction roll 95, depicted here by dashed lines, can, for example, also be incorporated here.

The support devices 54, 56 provided for internal support of the top press rolls 22, 24 may be acted upon in each case with the same pressure as the respective opposing support device 84 of the shoe press roll 20, 20'. The pressures for the respective elongated press nips S1, S2 can be separately or differently adjustable.

The felt 18 guided in the present case through the two elongated press nips S1, S2 is guided, downstream from the second elongated press nip S2, over a preferably pivotable felt guide roll 96.

The top felt 14 is guided, downstream from the first elongated press nip S1, over a preferably pivotable felt guide roll 97.

The upper press rolls 22, 24 are driven. The back upper press roll 24 is preferably driven with higher power than the front upper press roll 22, such that the press jacket 84, 40 of the shoe press roll 20, 20" (cf. also FIGS. 3 through 5) and the felt 18 guided through both elongated press nips S1, S2 in the present case is taut.

The tensile stress between the two long nip presses forming the press nips S1, S2 is held at least substantially constant by appropriate control and/or regulation of the press drives.

The intake wedge upstream from the first elongated press nip S1 is expediently subjected to suction between the top felt 14 guided through this press nip S1 and the front upper press roll 22.

The roll supports of the shoe press roll 20, 20' and of the two upper press rolls 22, 24 are expediently connected by form-fitting parts and can be quickly decoupled for felt and roll replacement.

At least one heating element 98 is provided above the deflection or transfer suction roll 36 provided between the elongated press nips S1, S2, which can, for example, be a steam blast box.

As depicted by dashed lines in FIG. 3, the support devices 54 or 56 provided for internal support of the upper press rolls 22, 24 may also be acted upon by the pressures p1 or p2 generated by the valve 94.

Figure 5:
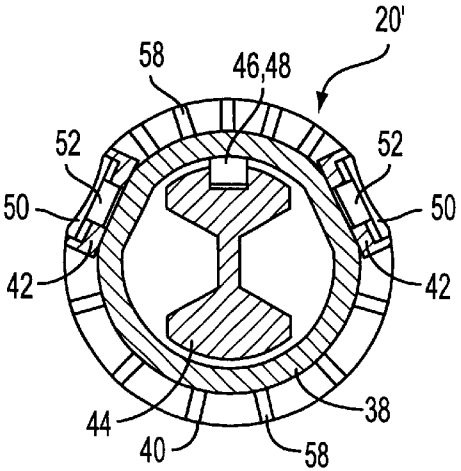
FIG. 5 is an enlarged, detailed cross-sectional depiction of another embodiment of the position-stable shoe press roll useable in the press arrangement according to FIG. 1 or 2.

FIG. 5 depicts an enlarged, detailed cross-sectional view of another embodiment of a position-stable shoe press roll 20' usable in the press arrangement according to FIGS. 1 and 2. In this case, the lower shoe press roll 20' includes a non-rotatably mounted hollow carrier 38, a flexible press jacket 40 surrounding the hollow carrier 38, as well as two outer support devices 42 with a distance between them, by which the press jacket 40 is supported on the hollow carrier 38 in the region of the two elongated press nips S1 and S2.

A likewise non-rotatably mounted inner carrier 44, on which the hollow carrier 38 is supported by a support device 46 such that a sag resulting from the variously oriented pressing forces generated in the region of the two elongated press nips S1 and S2 is at least substantially compensated, is associated with the outer hollow carrier 38.

The inner support device 46 disposed between the hollow carrier 38 and the inner carrier 44 includes at least one group of support elements 48 extending crosswise to the direction of travel of the web L. Each of the two outer support devices 42 has at least one press shoe 50 and also again in each case a plurality of support elements 52 disposed in a group extending crosswise to the direction of travel of the web L.

In the present case, each of the support elements 48 and 52 includes at least one cylinder/piston unit. The direction of action of the inner support device 46 lies in the resultant direction of action of the two outer support devices 42.

In the present exemplary embodiment, the support forces applied by the two outer support devices 42 have at least substantially the same size. The radial directions of action of the two outer support devices 42 are offset by approximately 120°. The direction of action of the inner support device 46 lies in the bisector of the angle between the two radial directions of action of the two outer support devices 42. In the present case, the forces applied by the two outer support devices 42 and the inner support device 46 have at least substantially the same size, such that they form an equilateral triangle of forces. For this, the group of support elements of the two outer support devices 42 and the inner support device 46 have the same pitch. Moreover, their support elements 52, 48 have the same piston areas.

The two outer support devices 42 and the inner support device 46 can be acted upon by the same preferably variably adjustable pressure.

The forces applied by the three support elements 42, 46 are thus in equilibrium. The support devices (cf. also FIG. 3) provided for inner support of the upper press rolls 22, 24 can be acted upon by the same pressure as the outer support devices 42 of the lower shoe press roll 20'.

As can be discerned from FIG. 5, jacket guide rails 58 are also provided between the hollow carrier 38 and the press jacket 40, by means of which the press jacket 40 is appropriately guided into the regions laid out in the circumferential direction between the press shoes 50.

Consequently, with the use of such a position-stable shoe press roll 20', the sagging of the hollow carrier 38 is controlled by the inner support device 46 such that sagging generated by the forces in the region of the two press nips S1 and S2 is at least substantially compensated. Thus, the hollow carrier 38 is no longer subject to sagging but rather now only to shell deformation.

To support the centrifuging of water, the press jacket 40 may again be executed in the shape of a polygon, in particular between the two elongated press nips S1 and S2.

As can be discerned from FIG. 2, the fibrous material web 10 is separated from the top felt 26 before it is transferred to the drying wire 32 in the region of the suction roll 30. The bottom felt 18 is likewise executed in the embodiment depicted in FIG. 1 along a descending discharge path from the second elongated press nip S2.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 fibrous material web
12 suction roll
14 top felt
16 wire
18 bottom felt
20 lower shoe press roll
20' lower shoe press roll
22 upper press roll
24 upper press roll
26 top felt
28 suction device
30 deflecting roll
32 drying wire
34 drying cylinder
36 suction roll
38 hollow carrier
40 press jacket
42 outer support devices
44 inner carrier
46 inner support device
48 support elements
50 press shoe
52 support elements
54 support device
56 support device
58 jacket guide rails
60 mount
62 bushings
64 blowpipe
66 suction device
72 channel
74 channel
76 channel
78 channel
80 hollow carrier
82 press jacket
84 support devices
86 inner carrier
88 press shoe
90 support elements
92 piston
94 valve
95 separating suction roll
96 felt guide roll
97 felt guide roll
98 heating element
L direction of travel of the web
S1 elongated press nip
S2 elongated press nip
p1 pressure
p2 pressure

What is claimed:

1. A press arrangement for the treatment of a fibrous material web, comprising:

two upper press rolls;

a lower shoe press roll;

the lower shoe press roll and the two upper press rolls being arranged to form, on the lower shoe press roll, press nips elongated in a direction of travel of the web;

a first of the elongated press nips, relative to the direction of travel of the web, being double felted; and a deflecting roll comprising a suction roll, wherein the fibrous material web is guided with one felt of the double felt between the elongated press nips and around said suction roll.

* * * * *